US007568414B2

(12) United States Patent
Farid et al.

(10) Patent No.: US 7,568,414 B2
(45) Date of Patent: Aug. 4, 2009

(54) MELON WEDGER

(75) Inventors: Tariq Farid, Hamden, CT (US); Kamran Farid, Hamden, CT (US)

(73) Assignee: Edible Arrangements, LLC, Wallingford, CT (US)

( * ) Notice: Subject to any disclaimer, the term of this patent is extended or adjusted under 35 U.S.C. 154(b) by 156 days.

(21) Appl. No.: 11/218,104

(22) Filed: Sep. 1, 2005

(65) Prior Publication Data

US 2007/0044619 A1 Mar. 1, 2007

(51) Int. Cl.
*B26D 3/26* (2006.01)
*B26D 5/10* (2006.01)

(52) U.S. Cl. ..... 83/435.19; 83/425.3; 83/588; 83/662; 83/857; 30/114

(58) Field of Classification Search ..... 83/588, 83/633, 932, 605, 613, 856–858, 435.15, 83/435.18, 435.19, 451, 425.3, 662; 30/114, 30/302; 99/545, 537, 506–508, 538; 100/94.98 R, 100/103, 902
See application file for complete search history.

(56) References Cited

U.S. PATENT DOCUMENTS

| | | | | | |
|---|---|---|---|---|---|
| 98,457 | A | | 12/1869 | Wright | |
| 182,133 | A | * | 9/1876 | Rogers | 99/545 |
| 419,722 | A | * | 1/1890 | Siersdorfer | 99/545 |
| 471,158 | A | | 3/1892 | Westerman | |
| 507,383 | A | * | 10/1893 | O'Connell | 83/435.19 |
| 590,129 | A | * | 9/1897 | Bulette | 76/101.1 |
| 608,368 | A | * | 8/1898 | Lawson | 83/425.3 |
| 853,796 | A | | 5/1907 | Imes | |
| 880,057 | A | * | 2/1908 | Wheeler | 83/588 |
| 925,693 | A | * | 6/1909 | Goodykoontz et al. | 83/435.19 |
| 1,250,676 | A | | 12/1917 | Segerc | |
| 1,399,950 | A | | 12/1921 | Fish | |
| 1,422,066 | A | | 7/1922 | Vafiades et al. | |
| 1,438,925 | A | * | 12/1922 | Lawrence | 83/157 |
| 1,479,369 | A | * | 1/1924 | Chounis | 83/425.3 |

(Continued)

FOREIGN PATENT DOCUMENTS

| | | |
|---|---|---|
| GB | 319 497 | 9/1929 |

(Continued)

*Primary Examiner*—Boyer D. Ashley
*Assistant Examiner*—Laura M. Lee
(74) *Attorney, Agent, or Firm*—Michaud-Duffy Group LLP

(57) ABSTRACT

A melon wedger is provided having a base upon which is removably attached a blade assembly having a plurality of blades arranged in a variety of orientations. A movable press mechanism including a removable contoured press element corresponding in size and shape to the orientation and disposition of the blades in the blade assembly is slidably attached to the base and is operated by means of a lever handle such that the contoured press element is forced against the blade assembly. Punch elements disposed on the surface of the contoured press element are forced within the voids created by the blades to ensure that the sectioned or cut food or non-food pieces are forced completely through the blade assembly. A spring is also provided on the lever handle to force the handle up after the food or non-food items have been sliced. Blade assemblies having different blade orientations and corresponding contoured press elements may be provided for cutting various shapes and sizes of food and non-food items, each of which may be easily attached to or removed from the melon wedger.

11 Claims, 7 Drawing Sheets

U.S. PATENT DOCUMENTS

| | | | | | |
|---|---|---|---|---|---|
| 1,744,422 | A | | 1/1930 | Taylor | |
| 2,373,781 | A | | 4/1945 | Richardson | |
| 3,060,838 | A | * | 10/1962 | Priore | 99/430 |
| 3,468,355 | A | | 9/1969 | Hall | |
| 3,830,151 | A | | 8/1974 | Gerson | |
| 3,924,501 | A | * | 12/1975 | Cohen et al. | 83/404.3 |
| 4,436,025 | A | | 3/1984 | Jones | |
| 4,573,384 | A | * | 3/1986 | Jones | 83/404.3 |
| D298,790 | S | | 12/1988 | Hutchinson | |
| 4,911,045 | A | | 3/1990 | Mendenhall | |
| 5,142,973 | A | | 9/1992 | Tur et al. | |
| 5,337,480 | A | | 8/1994 | Codikow | |
| 5,363,756 | A | | 11/1994 | Muro | |
| 5,373,781 | A | * | 12/1994 | Knasel | 99/542 |
| 5,421,249 | A | | 6/1995 | Repisky et al. | |
| 5,520,105 | A | * | 5/1996 | Healy | 100/98 R |
| 5,873,294 | A | * | 2/1999 | Sciuto | 83/588 |
| 6,748,854 | B2 | * | 6/2004 | Barnard | 99/541 |
| 2003/0079616 | A1 | | 5/2003 | Barnard | |

FOREIGN PATENT DOCUMENTS

| | | |
|---|---|---|
| GB | 2 286 110 | 8/1995 |
| GB | 2 312 613 | 11/1997 |
| WO | 93/10948 | 6/1993 |

* cited by examiner

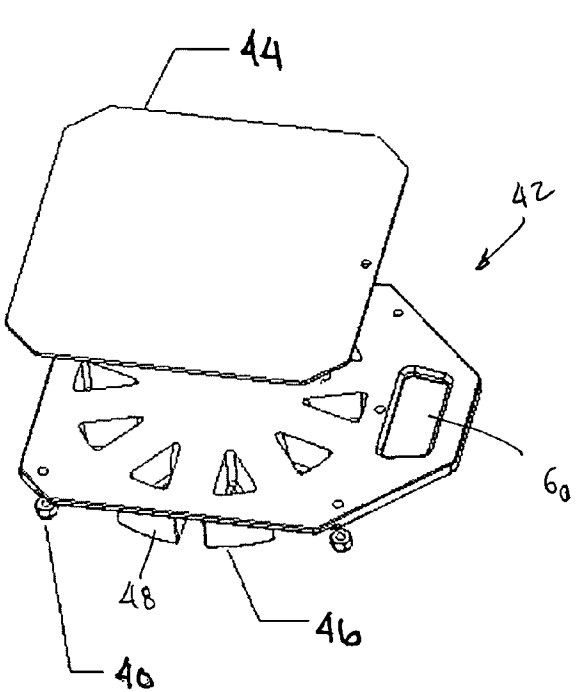
FIG. 5C
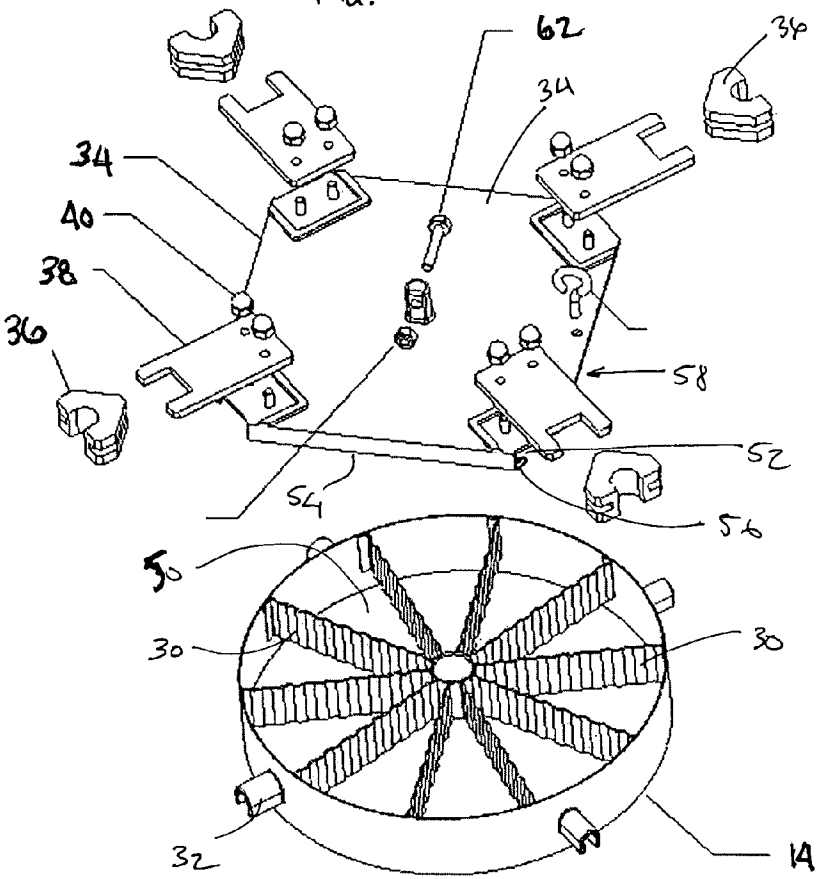
FIG. 5A
FIG. 5B

MELON WEDGER

BACKGROUND OF THE INVENTION

1. Field of the Invention

The present invention relates generally to the field of food preparation and display, and more particularly to a device for slicing melons and similar food and non-food items into wedges or slices for an ornamental display or for cooking, and even more particularly to a melon wedger having a changeable blade and press for cutting different sized wedges for different sized melons.

2. Description of the Prior Art

The use of wedgers to cut or slice melons and similar food or non-food items for cooking or display purposes has long been known. For example, U.S. Pat. No. 5,421,249 which issued to Repisky, et al. on Jun. 6, 1995 for "Food wedger" discloses a food wedger for slicing food such as apples into wedge shaped segments and coring the food, the wedger including a cutter assembly comprising a plurality of cutter blades radiating outwardly and upwardly from a central ring in an inverted cone-shaped radial array wherein a tapered segmented pusher having radial slots and a central pin is mounted for selective advancement through the cutter assembly.

Another such device is disclosed in U.S. Pat. No. 5,363,756 which issued to Muro on Nov. 15, 1994 for "Fruit and vegetable cutter" discloses a device including a cutter assembly having radially disposed blades fastened to a holding frame mounted on a base frame wherein two guide rods hold a vertically slidable press-down member having a concave pressing surface facing the blades. Similarly, U.S. Pat. No. 5,337,480 which issued to Codikow on Aug. 16, 1994 for "Subdividing device" discloses a device for subdividing a workpiece comprising a blade support structure having an opening with a plurality of blades sharpened on two edges projecting from the circumferential surface of the opening toward the middle to juxtapose attacking points and edges forming a channel through which a plunger mechanism urges the workpiece into contact with the attacking points and sharpened edges thereby subdividing the workpiece into segments.

Other examples of sectioning devices are disclosed in U.S. Pat. No. 4,911,045 which issued to Mendenhall on Mar. 27, 1990 for "Decorative form hydraulic food product cutting blade assembly" discloses a cutter blade assembly for the production of a decorative food core for use with hydraulic food cutting apparatus having a frame constructed from a series of sequential rings defining a longitudinal passageway and a plurality of strip knives arranged to define various segments of the longitudinal passageway connected to the rings; as well as in U.S. Pat. No. 4,436,025 which issued to Jones on Mar. 13, 1984 for "Sectioning device for rounded food articles" discloses a sectioning device including a conical cup of radial blades within which the food article is impaled on a central spike to which the central ends of the blades are joined such that the article is forced through the wedge-shaped spaces between the blades by an annular array of fingers depending from a plunger to which a handle is attached. The food item need not be a fruit or melon, as evidenced by U.S. Pat. No. 5,142,973 which issued to Tur, et al. on Sep. 1, 1992 for "Onion cutter" discloses a food cutting apparatus having a cutter assembly formed as a truncated cone by a plurality of radially extending cutter blades wherein the cutter assembly cuts through the work piece until it encounters stops which prevent it from passing completely through the work piece.

Older examples of such devices are shown in U.S. Pat. Nos. 3,830,151, 3,468,355, 1,744,422, 1,422,066, 1,399,950, 1,250,676, 853,796, 590,129, 471,158 and 98,457.

A device for also removing the rind from the fruit is disclosed in U.S. Patent Application No. 2003/0079616 which was filed in the name of Barnard on May 1, 2003 for "Melon cutter" discloses a melon cutter having a cutting basket including a plurality of arched wire cutters which extend to a central member, and a melon holder which can be forced down towards the cutting head such that the cutting basket can be rotated to separate the melon meat from the melon rind.

However, there are currently no wedgers offer the unique advantages of the present invention, namely a wedger having a changeable blade and press to allow for the slicing of different sized and shaped wedges for different sized melons.

SUMMARY OF THE INVENTION

Against the foregoing background, it is a primary object of the present invention to provide a melon wedger adapted to securely receive and cut fruit, food or non-food items.

It is another object of the present invention to provide such a melon wedger that may be used with food and non-food items of varying sizes and shapes.

It is another object of the present invention to provide such a melon wedger that includes a changeable blade and press mechanism to cut various shapes and designs.

It is but another object of the present invention to provide such a melon wedger in which the blade and press mechanism may be easily changed.

It is yet another object of the present invention to provide such a melon wedger that is inexpensive to manufacture It is but another object of the present invention to provide such a melon wedger that is easy to use with a variety of food and non-food items.

To the accomplishments of the foregoing objects and advantages, the present invention, in brief summary, comprises a melon wedger of the type having a base upon which is removably attached a blade assembly having a plurality of blades arranged in a variety of orientations. A movable press mechanism including a removable contoured press element corresponding in size and shape to the orientation and disposition of the blades in the blade assembly is slidably attached to the base and is operated by means of a lever handle such that the contoured press element is forced against the blade assembly. Punch elements disposed on the surface of the contoured press element are forced within the voids created by the blades to ensure that the sectioned or cut food or non-food pieces are forced completely through the blade assembly. A spring is also provided on the lever handle to force the handle up after the food or non-food items have been sliced. Blade assemblies having different blade orientations and corresponding contoured press elements may be provided for cutting various shapes and sizes of food and non-food items, each of which may be easily attached to or removed from the melon wedger.

BRIEF DESCRIPTION OF THE DRAWINGS

The foregoing and still other objects and advantages of the present invention will be more apparent from the detailed explanation of the preferred embodiments of the invention in connection with the accompanying drawings, wherein:

FIG. 5A is an exploded perspective view of the press mechanism of the melon wedger of FIG. 1;

FIG. 5B is an exploded perspective view of the blade assembly of the melon wedger of FIG. 1;

FIG. 5C is an exploded perspective view of the contoured press of the melon wedger of FIG. 1;

BRIEF DESCRIPTION OF THE PREFERRED EMBODIMENTS

Figure 1:
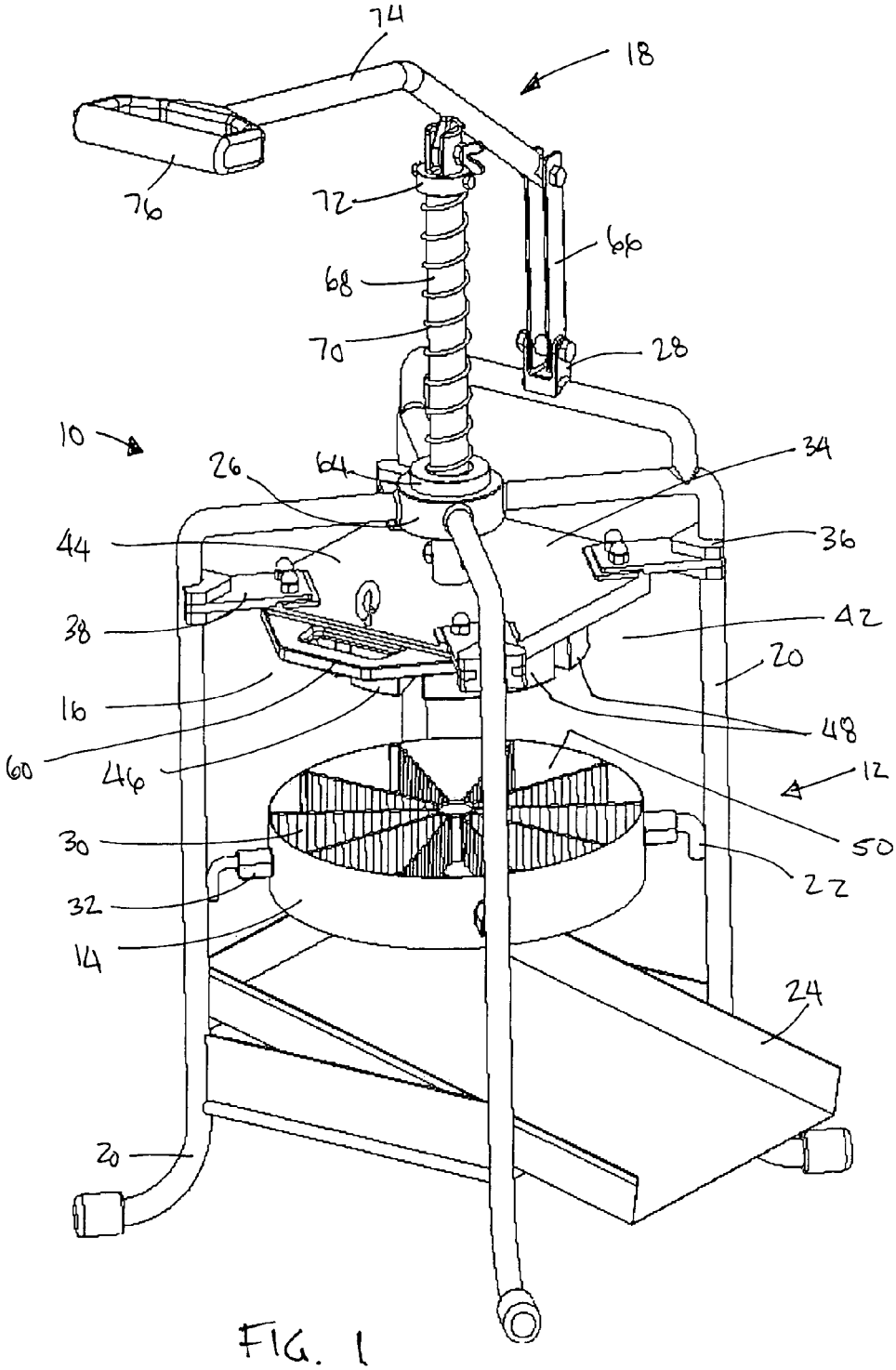
FIG. 1 is a perspective view of the melon wedger of the present invention.
Figure 2:
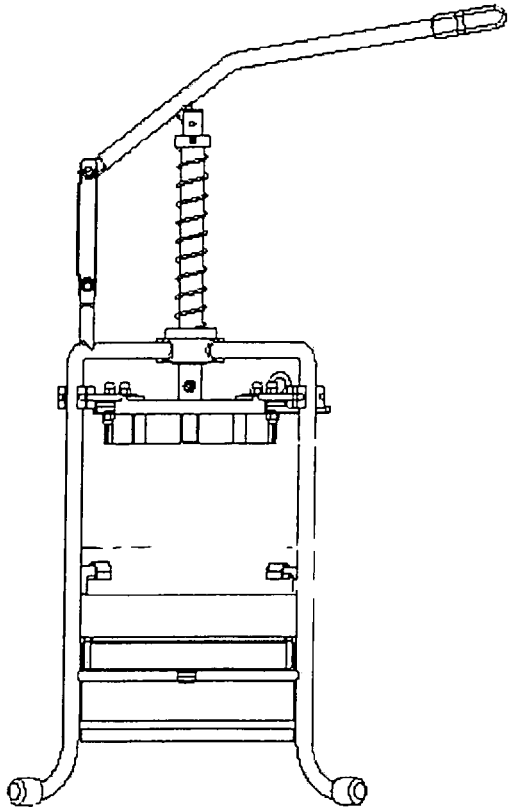
FIG. 2 is a left side plan view of the melon wedger of FIG. 1.
Figure 3:
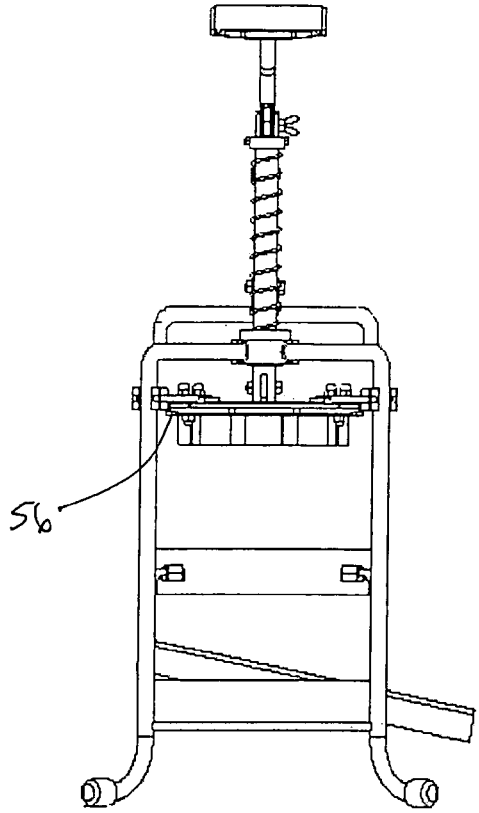
FIG. 3 is a front plan view of the melon wedger of FIG. 1.

Referring to the drawings and, in particular, to FIGS. 1-3 thereof, the melon wedger of the present invention is provided and is referred to generally by reference numeral 10. The melon wedger 10 comprises a base 12 upon which is provided a blade assembly 14 above which is mounted a press mechanism 16 operated by a movable lever handle 18. In operation, a food or non-food object is placed on the blade assembly 14, and the handle 18 is depressed so as to force the press mechanism 16 toward the blade assembly 14 to thereby slice the food or non-food item.

Figure 4:
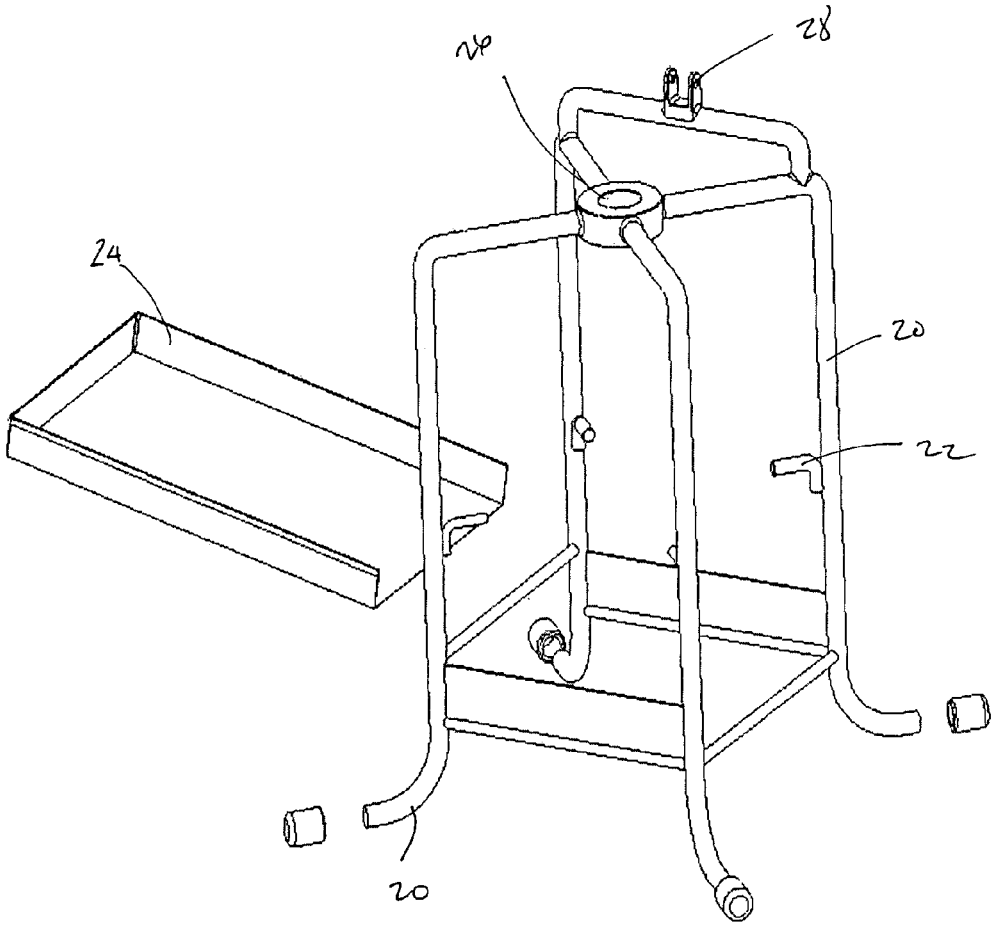
FIG. 4 is an exploded perspective view of the base of the melon wedger of FIG. 1.

Illustrated in FIG. 4 is the base 12 upon which the blade assembly 14 and press mechanism 16 are mounted. In the embodiment shown, the base 12 includes four legs 20 which support the melon wedger 10 and upon which are mounted projections 22 for receiving the blade assembly 14, which is removable. It should be appreciated that while the figures show the base 12 as having four legs 20, the base may be provided with fewer or more legs 20 as the application requires. Four legs 20 provide a stable structure while allowing for large items to be placed on the blade assembly 14. Providing more legs 20 would allow for a more stable melon wedger 10 at the expense of having a smaller area within which to insert fruit and the like.

In the preferred embodiment, the base 12 also includes a slide 24 for catching the sliced fruit and the like and depositing the slices on a plate or other object placed at the bottom of the slide 24. Of course, removing the slide 24 would allow the sliced fruit to fall directly down from the blade assembly 14, perhaps into a bowl. At the top of the base 12 is provided a centrally disposed sleeve 26 for receiving the press mechanism 16 as well as a pivot 28 distally-proximate from the sleeve 26, preferably at the outside upper edge of the base 12.

Illustrated in FIGS. 5A through 5C are the combination of the blade assembly 14 and the press mechanism 16. FIG. 5B shows the blade assembly 14 having ten blades 30 disposed in a radial pattern for creating ten wedge shaped slices from the fruit or other object placed in the melon wedger 10. It should be appreciated that the number and disposition of the blades 30 is immaterial to the operation of the melon wedger 10, as various different shapes and sized may be created by the melon wedger 10 merely by changing the number of blades 30, the shape of the blades 30 or the orientation and/or disposition of the blades 30. It should also be appreciated that while the blade assembly 14 is shown having a circular shape, other shapes may also be used both geometric and non-geometric, depending upon the particular application. Disposed around the edge of the blade assembly 14 are U-shaped elements 32 for engaging the projections 22. The U-shaped elements 32 are shaped and oriented on the blade assembly 14 so as to align with the projections 22 and thereby provide a stable platform for the blade assembly 14, allowing fruit or other objects to be pressed against the blades 30 from above and not move or slide down. The U-shaped elements 32 allow the blade assembly 14 to be lifted off the projections 22 and thereby removed from the base 12, and replaced with a different blade assembly 14 having a different configuration to the blades 30.

The press mechanism 16, illustrated in FIG. 5A includes a substantially flat surface 34 upon which are mounted guides 36. In the preferred embodiment, the guides 36 are attached to the flat surface 34 by sliding them onto extenders 38 which are, in turn bolted to the flat surface 34 by means of fasteners 40. It should be appreciated that the guides 36 are shaped so as to engage the legs 20 of the base 12 and allow the press mechanism 16 to be slid up and down the length of the legs 20, while preventing the press mechanism 16 from sliding off or otherwise disengaging from the base 12. While the press mechanism 16 is intended to be permanently attached to the base 12, it should be understood that the combination of the extenders 38 and fasteners 40 will allow it to be removed or replaced with another press mechanism 16.

Removably attached to the press mechanism 16 is a contoured press 42 which includes an upper surface 44 and a lower contoured form 46, the shape and size of which is complementary to the shape and size of the blade assembly 14. Specifically, the lower contoured form 46 includes punch elements 48 that correspond in size and shape to the voids 50 created by the blades 30 such that when the press mechanism 16 is slid down against the blade assembly 14, the punch elements 48 will slide through the voids 50, thereby forcing any object that is being sliced by the melon wedger 10 completely through the blade assembly 14.

In the preferred embodiment, the upper planar surface 44 is attached to the lower contoured form 46 by means of fasteners such as nuts and bolts, screws, rivets, or any other fastening means known in the art. In such embodiment, the contoured press 42 is removably attached to the press mechanism 16 by means of sliding the contoured press 42 into a channel 52 on the lower portion 54 of the press mechanism 16 created by a lip 56 that extends inwardly around the edges of the lower portion of the 54 and includes an opening 58 for receiving the lower contoured form 46. In this embodiment, the channel 52 created by the lower portion 54 and lip 56 corresponds in size and shape to the size and shape of the upper planar surface 44, being slightly larger in size so as to allow the contoured press 42 to be slid into and out of the channel 52. It should be understood that in such embodiment, the lip 56 extends out far enough to prevent the contoured press 42 from falling down out of the channel 52, but need not be so deep so as to interfere with the operation of the lower contoured form 46 or the punch elements 48. A press handle 60 may also be provided to facilitate the removal and insertion of the contoured press 42 into the press mechanism 16.

It should be appreciated that while the figures show the upper surface 44 to be planar, all that is required is that the edges of the upper surface 44 be co-planar so as to allow the contoured press 42 to be slid into the channel 52.

Figure 6:
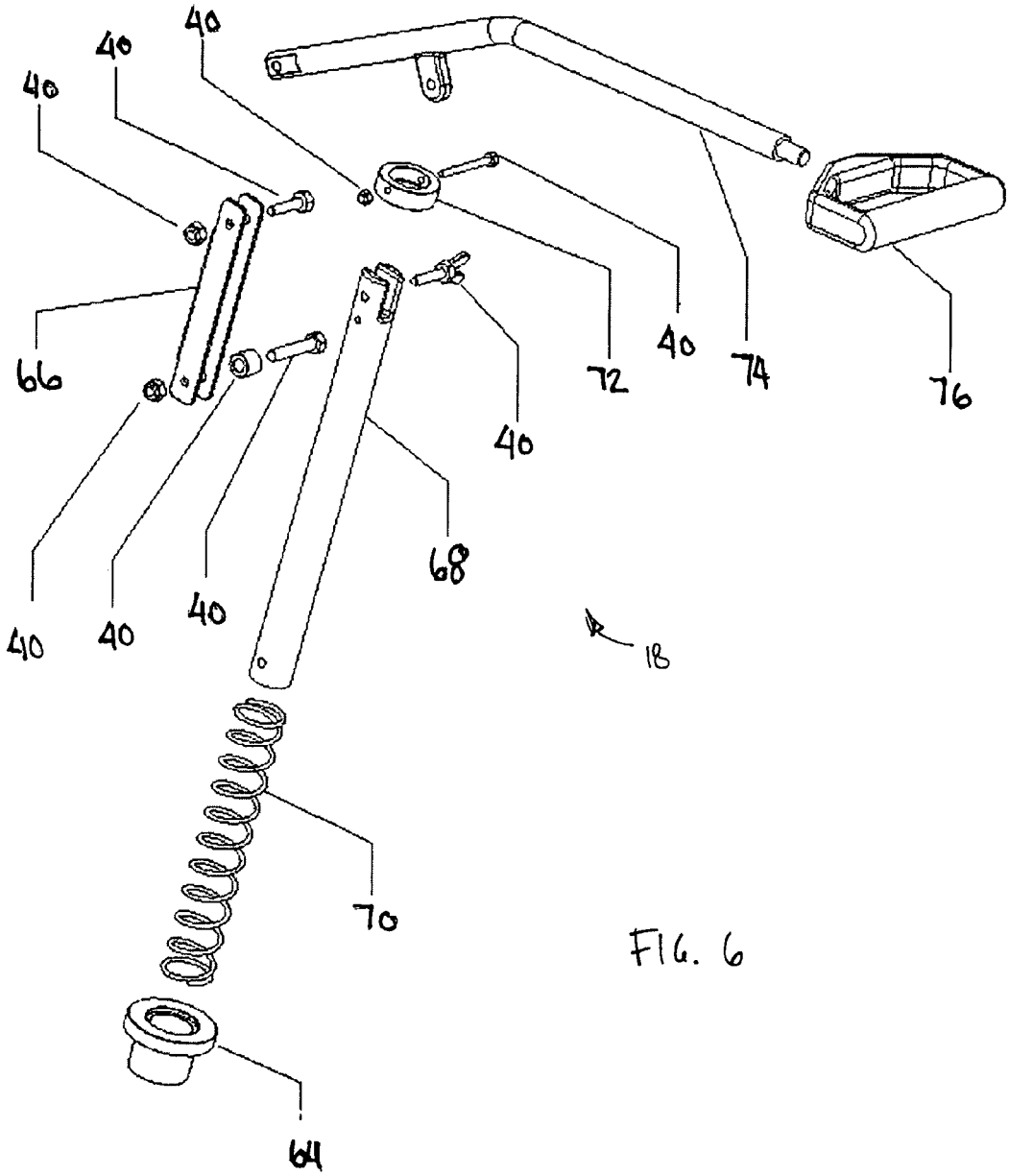
FIG. 6 is an exploded perspective view of the lever handle of the melon wedger of FIG. 1.
Figure 7:
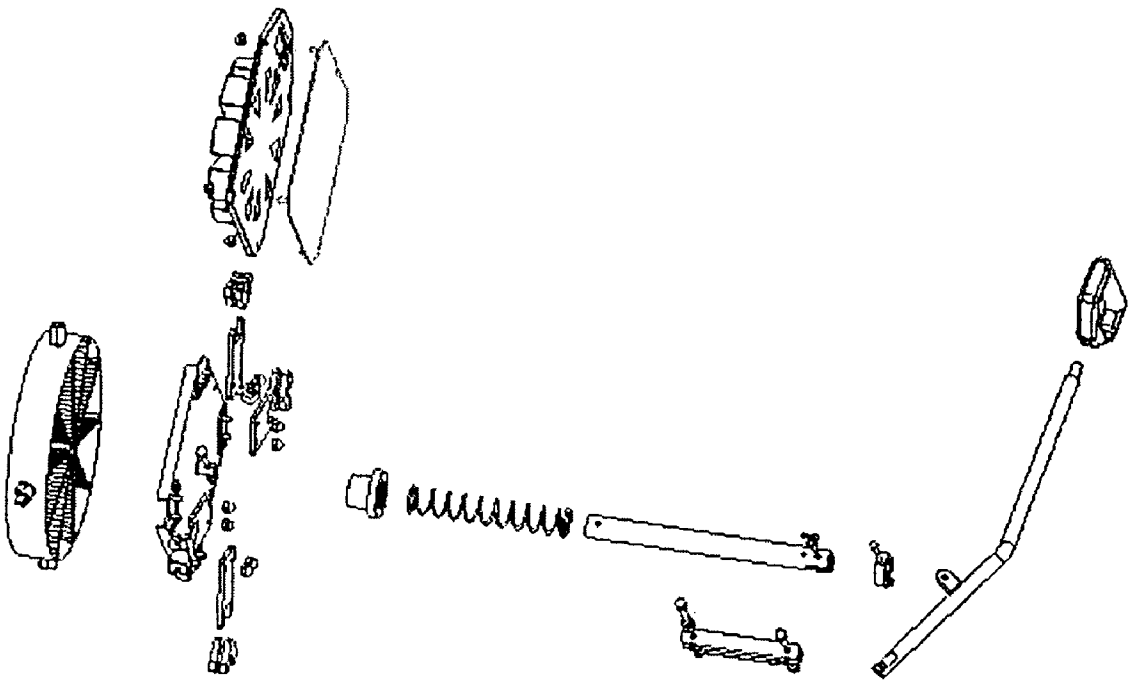
FIG. 7 is an exploded perspective view of the melon wedger of FIG. 1 showing all elements thereof.
Figure 7:
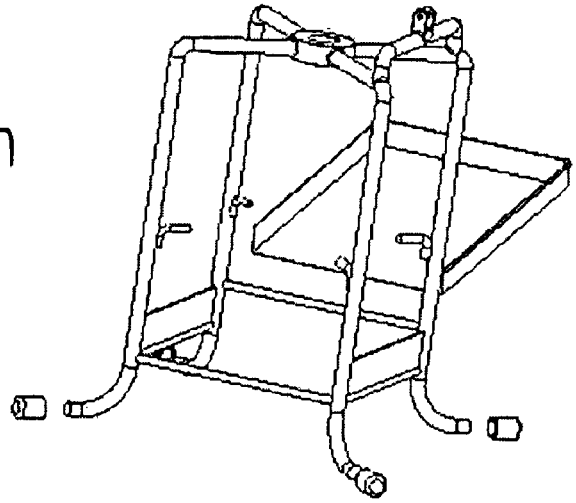
Figure 8A:
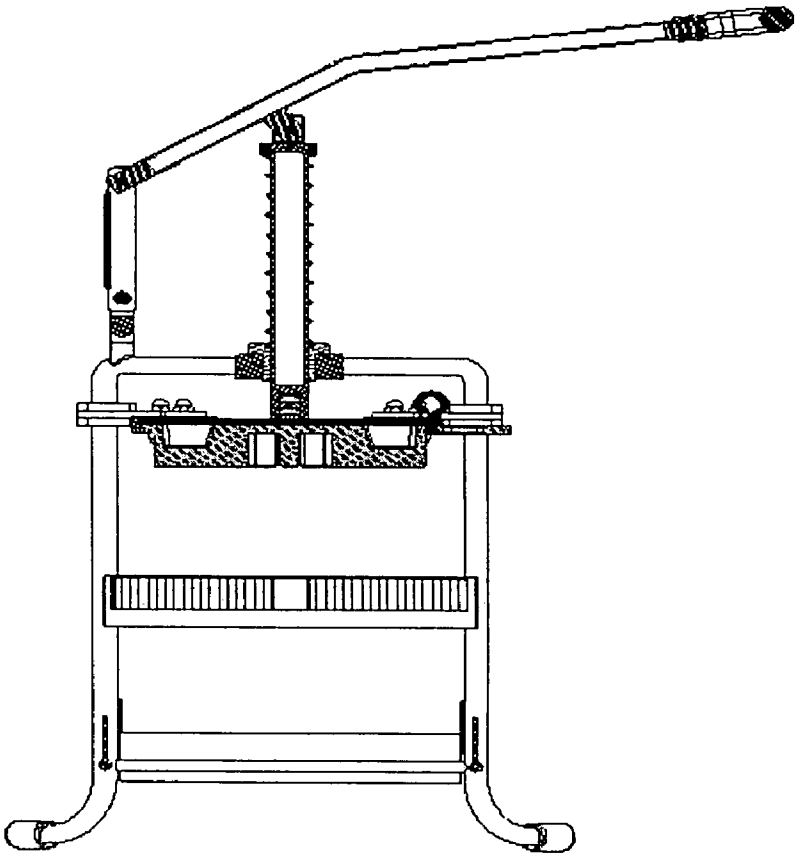
FIG. 8A is a cross-sectional view along plane A-A of the melon wedger of FIG. 1.
Figure 8:
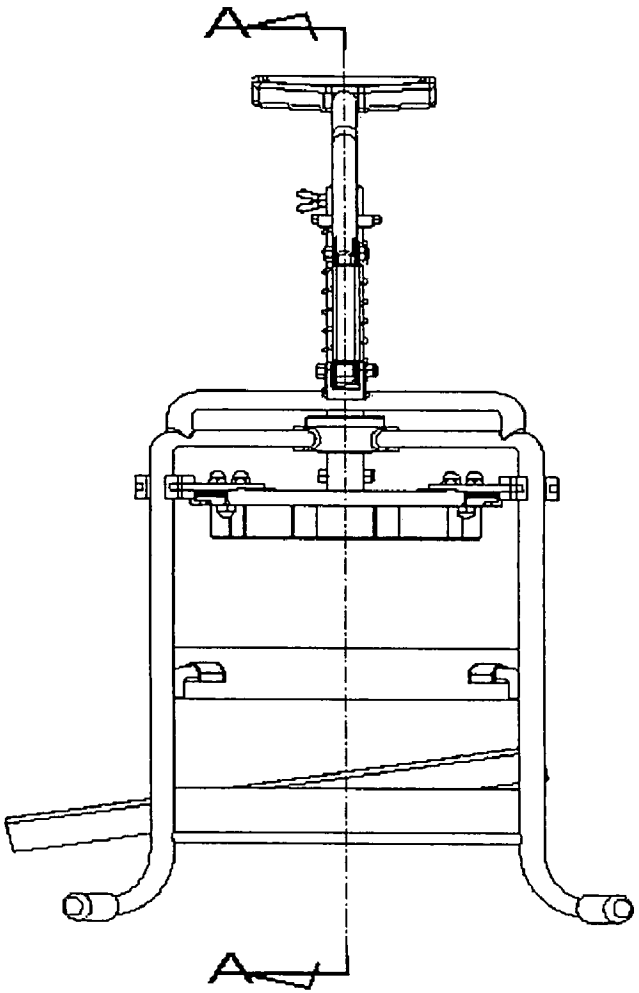
FIG. 8 is a right side plan view of the melon wedger of FIG. 1.

Finally, illustrated in FIG. 6 are the components of the movable handle 18, which is attached to the press mechanism 16. The movable handle 18 is essentially a lever mechanism that includes a linkage 66 attached to the pivot 28 by means of fasteners 40, which in the preferred embodiment is a pin or nut and bolt, and a lever rod 68 attached to the hinged joint 62 on the press mechanism 16 by means of a fastener 40 such as a pin. A sliding collar 64 is provided for engaging the sleeve 26 through which the lever rod 68 passes, and a spring 70 is further provided for engaging the sliding collar 64 and an upper collar 72 located at the top of the lever rod 68, which spring 70 serves to force the movable handle 18 up after it has been depressed to slice the fruit or other object. The lever rod 68 is forced down by means of a lever shaft 74, which is attached to the lever rod 68 at the upper collar 72, which attachment allows for rotational movement of the lever shaft 74 relative to the lever rod 68. The lever shaft 74 terminates in a grip 76 that facilitates the operation of the movable handle 18 and thereby the press assembly 16.

Having thus described the invention with particular reference to the preferred forms thereof, it will be obvious that various changes and modifications can be made therein without departing from the spirit and scope of the present invention as defined by the appended claims.

We claim:

1. A device for slicing food and non-food items, said device comprising:

a base having a plurality of substantially vertical and independent legs, each said leg having a vertical portion with an upper portion and a lower portion;

each said lower portion providing a separate foot for standing on a fixed surface;

each said upper portion terminating on a centrally located fixed sleeve;

a removable blade assembly having a plurality of vertically orientated blades creating a plurality of vertically orientated voids therebetween, wherein disposed on each of said legs is a projection, and further wherein disposed on said blade assembly are a plurality of U-shaped elements that correspond in size, shape, orientation and location to said projections such that said blade assembly may be removably attached to said base at said projections; and a press mechanism including a removable contoured press complementary to said removable blade assembly, wherein said contoured press includes slidable attachment means for removably attaching said contoured press to said press mechanism, said slidable attachment means including an upper element having a planar edge and said press mechanism including a channel therein for slidably receiving said planar edge of said contoured press;

said contoured press having a plurality of punch elements corresponding in size and shape to said plurality of voids in said removable blade assembly such that said punch elements may be inserted into said voids during operation of said device;

said press mechanism being attached to said base by guides, said guides engaging said vertical portion of said legs thereby enabling said press mechanism to slide up and down said legs; and a moveable lever handle assembly attached to at least two said upper portions of said legs and to said press mechanism for forcing said food and non-food items against said blade assembly to thereby slice said food and non-food items; wherein said movable lever assembly includes a push rod and wherein said fixed sleeve guides said push rod up and down to thereby raise and lower said press mechanism;

wherein said legs provide structural support to said blade assembly and said press mechanism.

2. The device of claim 1, wherein said blades are disposed in a radial pattern and said punch elements are wedge-shaped.

3. The device of claim 1, wherein said press mechanism includes a lower portion and a lip extending inwardly therefrom to thereby create said channel.

4. The device of claim 3, wherein said channel is complementary in shape and is slightly larger in size to said contoured press.

5. The device of claim 1, further including a tilted slide for catching falling sliced food and non-food items wherein said slide catches said falling food items and non-food items in an upper portion of said slide located directly below said voids and gravity causes said food items and non-food items to move to a lower portion of said slide, said lower portion terminating outside an enclosed area circumscribed by said feet of said legs.

6. The device of claim 1, wherein said moveable lever assembly includes a fixed collar that guides said push rod though said fixed sleeve.

7. The device of claim 6, further including a helical spring located longitudinally on said push rod to force said push rod upwards.

8. The device of claim 7, further including a grip to facilitate the operation of said movable level handle assembly.

9. The device of claim 8, wherein said movable lever handle assembly is attached to at least two of said horizontal upper portions of said base by means of a hinged element and wherein said lever rod is attached to said press mechanism such that pressing down on said movable lever handle assembly forces said push rod down and thereby forces said press mechanism towards said blade assembly.

10. A device for slicing food and non-food items, said device comprising:

a base, having a plurality of vertical and independent legs, each said leg having an upper portion and a lower portion;

each said lower portion providing a separate foot for standing on a fixed surface;

each said upper portion comprising a substantially horizontal segment terminating on a centrally fixed sleeve;

a removable blade assembly comprising a plurality of blades creating a plurality of voids therebetween, wherein disposed on each of said legs is a projection, and further wherein disposed on said blade assembly are a plurality of U-shaped elements that correspond in size, shape, orientation and location to said projections such that said blade assembly may be removably attached to said base at said projections;

a press mechanism including a removable contoured press complementary to said removable blade assembly, wherein said contoured press comprises a plurality of punch elements corresponding in size and shape to said plurality of voids in said blade assembly such that said punch elements may be inserted into said voids during operation of said device, and further wherein said contoured press includes slidable attachment means for removably attaching said contoured press to said press mechanism and an upper element having a planar edge and said press mechanism includes a channel therein for receiving said planar edge of said contoured press, wherein said press mechanism is attached to said base by means of guides attached to said press mechanism, wherein said guides engage said legs;

a slide for catching falling sliced food and non-food items wherein said slide catches said food and non-food items in an upper portion of said slide located directly below said voids and gravity causes said food and non-food items to move to a lower portion of said slide, said lower portion terminating outside an enclosed area circumscribed by said feet of said legs; and a movable lever handle attached to said base and to said press mechanism for forcing said food and non-food items against said base assembly to thereby slice said food and non-food items, wherein said fixed sleeve guides a lever rod up and down to thereby raise and lower said press mechanism and a spring forces said lever rod upwards, wherein said movable lever handle is attached to said base by means of a hinged element and wherein said lever rod is attached to said press mechanism such that pressing down on said lever handle forces said lever rod down and thereby forces said press mechanism towards said blade assembly.

11. The device of claim 10, wherein said blades are disposed in a radial pattern and said punch elements are wedge-shaped.

* * * * *